United States Patent [19]

Waller

[11] 3,993,379

[45] Nov. 23, 1976

[54] MERCURY ELECTRODELESS DISCHARGE LAMP AND METHOD OF ITS FABRICATION

[75] Inventor: William J. Waller, Monroe, Conn.

[73] Assignee: The Perkin-Elmer Corporation, Norwalk, Conn.

[22] Filed: Dec. 22, 1975

[21] Appl. No.: 643,375

[52] U.S. Cl. ..... 316/20; 316/24; 313/201; 313/225; 313/227

[51] Int. Cl.[2] ..... H01J 9/38

[58] Field of Search ..... 316/20, 24, 30; 313/201, 223, 225, 227

[56] References Cited

UNITED STATES PATENTS 3,787,106 1/1974 Schermerhorn ..... 316/17

3,868,525 2/1975 Waymouth et al. ..... 313/225 X

*Primary Examiner*—Richard B. Lazarus

*Attorney, Agent, or Firm*—S. A. Giarratana; F. L. Masselle

[57] ABSTRACT

Disclosed is a mercury electrodeless discharge lamp for use in spectrophotometric analysis, particularly atomic absorption spectrophotometry, and a method of its fabrication. Unreduced mercuric oxide (HgO) is employed as the source of mercury in the lamp. In fabricating the lamp, a small quantity of mercuric oxide is introduced into a lamp bulb which has been previously cleansed and flushed with noble gas. The bulb is heated to a temperature just below the decomposition point of the mercuric oxide. The bulb is then flushed with a noble gas, filled to the desired pressure with a noble gas and sealed.

5 Claims, No Drawings

MERCURY ELECTRODELESS DISCHARGE LAMP AND METHOD OF ITS FABRICATION

BACKGROUND OF THE INVENTION

1. Field of the Invention

This invention relates to electrodeless discharge lamps (EDL's) of the type employed for spectrophotometric analysis, particularly in atomic absorption and atomic fluorescence spectrophotometry, and more specifically to lamps and methods of fabricating lamps for use as mercury spectral line sources.

2. Description of the Prior Art

The advantages of EDL's over other spectral sources, e.g., hollow cathode lamps, in terms of attainable detection limits for some elements are well known and, consequently, there has been considerable activity in recent years directed toward the development and utilization of EDL's where hollow cathode lamps have previously been employed.

The general requirements for EDL's are also well known: good stability, high intensity, and long life. The realization of these requirements, however, has been more difficult for some elements than others and, among the elements which have presented particular problems is mercury.

A resume of past efforts in the construction and operation of EDL's is presented in a paper entitled, "The Preparation and Operation of Electrodeless Discharge Lamps - A Critical Review" by J. P. S. Haarsma, G. J. DeJong, and J. Agterdenbos, published in *Spectrochimica Acta*, Volume 29B, pages 1 to 18. From this publication, it will be noted that, for the most part, mercury EDL's have been fabricated using elemental mercury rather than mercury compounds. Mercury compounds, e.g., mercury iodide, and mercury amalgams have also been employed. None of these have produced entirely satisfactory results, tending to give too intense an output or, where sufficient material is introduced to lower intensity, short life has resulted.

SUMMARY OF THE INVENTION

It has been found that the shortcomings of mercury EDL's as outlined above can be overcome by the utilization of mercuric oxide (HgO) as a source of mercury. Insofar as is known, mercury oxide has not been utilized in the fabrication of EDL's. In the aforementioned publication, reference is made to utilizing mercuric oxide in the preparation of a mercury EDL, but the oxide was reduced to elemental mercury with hydrogen.

DESCRIPTION OF THE PREFERRED EMBODIMENT

In accordance with the present invention, the fabrication of a mercury EDL can be carried out in any of a variety of specific ways well known to the art with the exception that mercuric oxide rather than elemental mercury, a mercury amalgam or other compound is utilized as the mercury source.

The basic steps entail the preparation of the bulb by thorough cleansing which may include degassing and flushing with a noble gas. This accomplished, a small quantity of mercuric oxide is placed in the bulb and the bulb filled with a noble gas, e.g., argon or helium at low pressure. The bulb is then heated indirectly to a temperature just below the decomposition point of HgO which is indicated by a change in color from orange to bright red. The bulb is flushed once again with noble gas, filled with noble gas to a relatively low pressure (a pressure of 4 torr has been found satisfactory), and sealed in the usual manner. As will be appreciated from the above-cited prior art publication, there are a number of variable parameters involved in the structure and fabrication of EDL's including, for example, the diameter and length of the lamp; the quantity of the source material which is, of course, interrelated with the volume of the bulb; the identity and pressure of the noble fill gas; as well as the various techniques for cleaning, flushing, etc. The present invention relates fundamentally to the use of mercuric oxide as the source material rather than to particular details of lamp structure or fabrication techniques.

The following discussion is believed to be applicable to the operation of mercury EDL's in accordance with the present invention; however, it is explanatory only and its accuracy is in no way critical to an understanding and utilization of the invention.

Under ambient conditions, the following equations apply:

$$2\ HgO + 500°\ C \rightarrow 2\ Hg + O_2 \quad (1)$$

$$2\ Hg + O_2 + 350°\ C \rightarrow 2\ HgO \quad (2)$$

The reaction represented by equation (1) is not sensitive to excess temperature and proceeds very rapidly while that represented by equation (2) is very temperature sensitive and slow. However, in the presence of a noble gas plasma:

$$Hg + O \longrightarrow HgO \quad (3)$$

The reaction represented by equation (3) is not temperature sensitive except with respect to lamp intensity.

A mercury EDL utilizing mercuric oxide as the mercury source as described hereinabove, is characterized by good stability and high intensity and has a very much longer useful life than mercury EDL's utilizing other mercury sources.

What is claimed is:

1. A method of fabricating a mercury electrodeless discharge lamp in which unreduced mercuric oxide (HgO) is introduced into the lamp cavity as the source of mercury therein.

2. A method of fabricating a mercury electrodeless discharge lamp comprising the steps of:

a. providing a radiation transparent lamp bulb;
b. cleansing, evacuating and flushing the bulb with a noble gas;
c. filling the bulb with noble gas at low pressure;
d. introducing a small quantity of mercuric oxide into the bulb;
e. heating the bulb indirectly to a temperature below the decomposition point of mercuric oxide;
f. filling the bulb to the desired pressure with noble gas; and
g. sealing off the bulb.

3. A method according to claim 2 wherein said noble gas is argon.

4. As an article of manufacture, a mercury spectral source consisting of an electrodeless discharge lamp containing mercuric oxide and a noble gas at low pressure.

5. An article of manufacture according to claim 4 wherein said noble gas is argon.

* * * * *